United States Patent [19]

Fleissner

[11] Patent Number: 4,665,815

[45] Date of Patent: May 19, 1987

[54] METHOD FOR WRAPPING A BALE OR THE LIKE

[75] Inventor: Gerold Fleissner, Chur, Switzerland

[73] Assignee: Vepa Aktiengesellschaft, Riehen/Basel, Switzerland

[21] Appl. No.: 786,549

[22] Filed: Oct. 11, 1985

[30] Foreign Application Priority Data

Oct. 16, 1984 [DE] Fed. Rep. of Germany ..... 3437884

[51] Int. Cl.[4] ..... B65B 13/04

[52] U.S. Cl. ..... 100/2; 100/3; 100/26; 100/30

[58] Field of Search ..... 100/26, 29, 30, 2, 3

[56] References Cited

U.S. PATENT DOCUMENTS 3,447,447 6/1969 Rutty ..... 100/30 X 3,450,028 6/1969 Goland ..... 100/30 X

*Primary Examiner*—Billy J. Wilhite

*Attorney, Agent, or Firm*—Antonelli, Terry & Wands

[57] ABSTRACT

A method for wrapping a bale or the like with a wire or band held together by a tubular seal is described wherein wire is pushed through a metal tube held in readiness, then looped around the bale, and the free end of the wire is again moved through the metal tube. After the wire has been passed twice through the metal tube held in readiness; the wire feed is arrested by means of a limit switch; the portion of the wire end projecting out of the crimping jaws is bent around the metal tube; and tightening around the band is completed. Then the seal is produced by moving the crimping jaws toward each other and simultaneously severing the band from the supply coil. The wrapping operation takes place fully automatically. For this purpose, an apparatus is provided which holds the respectively next needed metal tube exactly into the path of movement of the wire to be extended around the bale.

5 Claims, 3 Drawing Figures

METHOD FOR WRAPPING A BALE OR THE LIKE

The invention relates to a method for wrapping a bale or the like structure, preferably formed of synthetic fibers, for example, by means of a metal wire or band which taken from a supply coil, is extended around the bale, held at the ends, tightened around the bale by backward movement of the portion of the band connected to the supply coil, and the ends are joined by means of a tubular member surrounding the ends; and to an apparatus for performing the method.

A similar method is described in DOS No. 3,216,883. The apparatus disclosed therein has the advantage that permanent baling of a fiber bale by means of a wire is made possible, the wire ends being joined by means of a seal formed of a tubular metal piece. This is done by seizing the wire section looped around the bale at a spacing from the end by a holding and closing device, placing a metal tube onto this freely projecting end section, cutting the other end section of this wire, initially connected to the supply coil, in a predetermined length, seizing this end section likewise at a spacing from the end by means of a holding and closing device, tightening the wire, pushing the end section through the metal tube placed over the other end section, and finally compressing this tube for producing the seal or closure.

It has been found that this sequence of operating steps for establishing a metal seal connection does not ensure a permanent connection in all applications. For example, it is unavoidable during the compression of synthetic fiber bales that the dimensions of this bale sometimes become larger or sometimes smaller. The wire, however, must adapt itself to the peripheral surface of the bale, which is difficult if the wire, prior to sealing, is cut to a specific measure. It is likewise difficult to releasably seize the wire at a spacing from an end by means of a device and to push the metal sleeve over this section. These motion processes are difficult to automate. There is also the danger that the seizing and closing device deforms the wire while being clamped therearound, so that, after the seal has been produced, a detachment of the clamping device from the wire is no longer possible.

The invention is based on the object of developing a method and apparatus for performing a procedure for making it possible to establish a permanent, firm wrapping of a bale or the like by use of a wire and a wrapping seal, providing an encircling closed seal, wherein the bale can have any desired dimensions, respectively, without having to releasably seize the wire for tightening the loop, and without there being the danger that the required wire section around the bale is previously cut off too short or too long.

Starting with the method of the type discussed hereinabove, the invention resides in that the portion of the wire coming from the supply coil is first passed with its free end through a metal tube held in readiness, the band is then extended around the bale; the advanced free end is guided a second time into the metal tube and fixed therein; then this wire is tightened around the bale by rearward movement of the band through the metal tube; the metal tube is crimped to form the seal, and the portion of the wire still connected to the supply coil is severed. Since, in this method, the wire is cut off from the supply coil after the seal or closed connection has been produced, the external dimensions of the bale are of no consequence for the establishment of a permanent connection. Also, the wire need not be releasably seized, either for tightening around the bale or for producing the seal, so that a seizing and closing device of the conventional type can be omitted in the method of this invention.

It is advantageous in order to simplify the operating steps of the method to sever the wire from the supply coil at the same time that the metal tube is being pressed together. The affixing of the wire to the metal tube, which is necessary to tighten the wire around the bale, takes place in a simple way by providing that the free end, previously extended around the bale, passes completely through the metal tube a second time, and a short, projecting piece of the wire is bent around the end of the metal tube. The bending of the end can again be eliminated after producing the seal, by straightening the wire, so that possible injury to a person by the bent end, or damage to the packaged material, can be avoided.

Automation of this wrapping procedure according to this invention has thus been made possible in a simple way in that continuously a metal tube is taken by a holding means from a magazine, held into the route of travel of the wire, the wire—as described—is passed twice through the metal tube, the free end of the wire is fixed, and then the holding means is separated from the seal for the subsequent crimping of the metal tube, to form the seal.

This wrapping step can be executed with one wire, but advantageously also with two wires, wherein, in such a case, four ends are joined by means of a seal. The use of two directly juxtaposed wires at the same time is more advantageous insofar as a wire can exhibit only a specific thickness to be bendable without problems around the bale by the guide means. With the use of two wires, the bales can be compacted to a greater extent with higher compressing pressures, which is of essential importance as regards the space required during shipping of the bales.

The apparatus for performing this method is likewise of the type of apparatus known from DOS No. 3,216,883. The novel apparatus of the present invention is characterized by the following features:

(a) a small metal tube respectively adjusted to be located in the path of movement of the wire fed from the supply coil, this metal tube being transferred by a movable holding device from a magazine and placed into the operative position;

(b) an additional guide duct for guiding the advanced, free end of the wire again into the metal tube;

(c) a device for fixing the free wire end in or at the metal tube; and (d) a cutting device for severing the wire, tightened around the bale, from the supply coil after the sealing step.

Each of the above features can be advantageously enchanced by additional details which pertain to the subject matter of this invention and are described in detail in the description of the accompanying drawings.

One embodiment of the apparatus is shown in detail in the drawings wherein.

Figure 1:
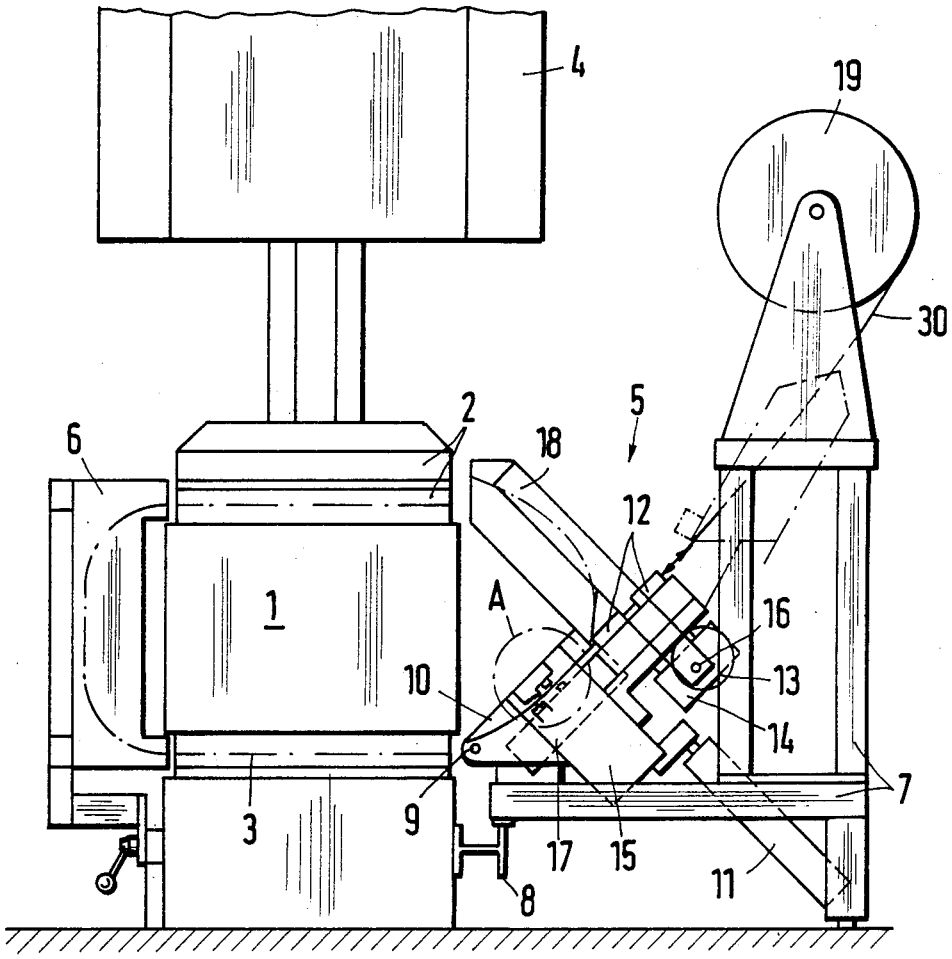
FIG. 1 shows schematically an elevational view of a fiber baling press in the zone of the bale to be wrapped, with a wrapping device movable laterally of the bale.

The fiber baling press for compacting a bale 1 consists of a press ram 2 and a counterpressure plate 3. In order to compress the fibers, the four lateral surfaces of the bale 1, presently vacant or exposed are surrounded by press jacket 4 which after termination of the compacting step, is then withdrawn off the bale 1 upwardly (as shown) so that the bale 1 can be wrapped. The bale 1, free along four sides, which is held in the compressed condition by the press ram 2 and is advantageously packaged previously along the six peripheral faces during the compacting operation of wire, is provided with several wraps by means of a wrapping device 5 arranged on the right-hand side beside the bale 1 and displaceable past the bale. A prerequisite therefor is, first of all, that the press ram as well as the counterpressure plate 3 exhibit guide ducts through which a wire can be inserted. On the side of the bale 1 opposed to the wrapping device 5, a rearward means 6 is furthermore detachably mounted which is used for automatically bending upwards the wires initially threaded through the counterpressure plate 3 and for guiding the wires back to the wrapping device 5 through the press ram 2 (the path of the wire 30 is shown by a dot-dash line).

The wrapping device 5 consists of a rack 7 arranged on the floor and being displaceable along the width of the bale 1 by the provision of a guide bearing on a support 8 mounted to the press. This movability of the baling device is of importance for the illustrated embodiment in order to be able to place several bands around the bale held in the press, using only one wrapping device 5. It is also possible to move the bale past the wrapping device, or to arrange several of such wrapping devices in side-by-side relationship, which devices then place the required bands.

An arm 10 is mounted to the rack 7 to be pivotable about an axle 9 by means of a piston-cylinder unit 11 at the level of the lower longitudinal edge of the bale 1. All of the individual components for laying the band around the bale and also for sealing are arranged on this arm 10. This includes, first of all, the wire feed 12 consisting of two superimposed roller pairs which seize the wire 30 in series, respectively, between them in an annular groove and which are driven in the forward as well as rearward directions by the motor 13 with a gear mechanism 14 (this movement is shown by the double arrow). A sealing and cutting device or means 15 is located below the wire feed 12, a guide arm 18 is retained on the arm 10, to be pivotable about an axle 16 by means of a pressure piston-cylinder unit 17, for the purpose of being able to return the wire 30'', advanced by the press ram 2, back to the metal tube holder shown in FIG. 2.

The wrapping of the bale 1 with a wire 30 takes place by means of this arrangement as follows. The wire 30, fed from the supply coil 19, which coil can also be disposed separately from the rack 7, is pushed by means of wire feed 12 through a metal tube 20 held in readiness as also shown in FIG. 2, and then guided through the guide ducts in the counterpressure plate 3, in the rearward unit 6, and in the press ram 2 back again to the wrapping device 5. From there, the wire 30'' runs automatically into the guide duct of the guide arm 18 and thus back to the metal tube 20 and again therethrough. During the second move of the wire 30'' through the metal tube 20, a limit switch cuts off the band feed 12, then the free wire end is fixed at the metal tube (see, in this connection, description of FIG. 3), then the guide arm 18 is swung with the aid of the drive mechanism 17 about the axle 16 into the position shown in dot-dash lines, and finally the wire feed 12 is run backwards for tightening the wire 30 about the bale 1, the wire 30 being pulled out of the guide ducts on the three sides of the bale 1. At the same time, with the aid of the drive mechanism 11, the arm 10 of the wrapping device 5 is swung against the bale 1, thus placing the wire 30 into relatively firm contact around the bale 1. Subsequently, the sealing device according to FIG. 3 is activated, and the portion of the wire 30 in connection with the supply coil is severed from the seal 20' formed of the crimped tube 20. At this point in time, the drive mechanism 11 can swing the arm 10 of the wrapping device 5 back again into the position shown in FIG. 1, and thus the wrapping device 5 can travel in parallel to a further wrapping plane past the bale 1.

Figure 2:
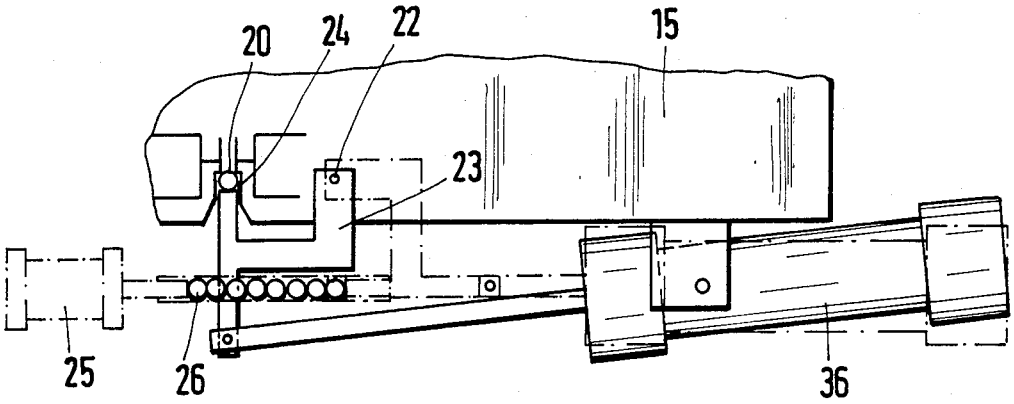
FIG. 2 shows a schematic view of means for the automatic feeding of, respectively, one metal tube to the wrapping device.
Figure 3:
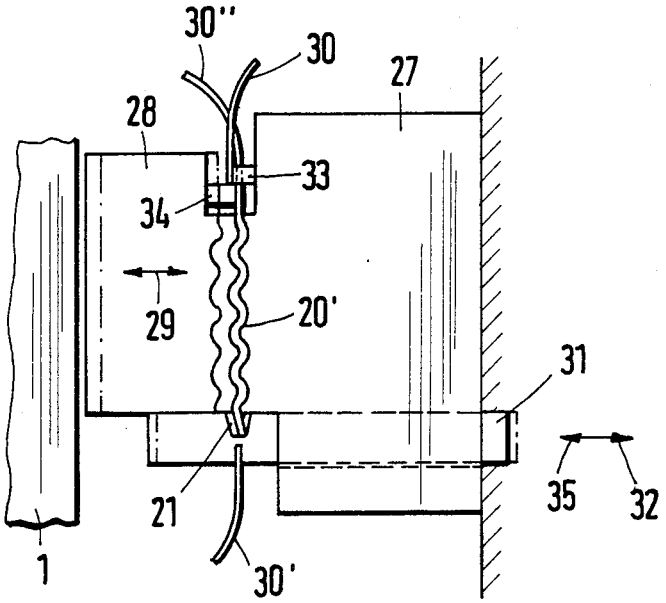
FIG. 3 shows detailed view A of FIG. 1 on an enlarged scale.

FIGS. 2 and 3 show the details of the sealing and cutting device 15 of FIG. 1. The metal tube holder according to FIG. 2 consists essentially of an arm 23 mounted at the member 15 to be pivotable about the axis 22; this arm can be swung outwardly from its operative position illustrated in FIG. 2 by 90° with the aid of the pressure piston-cylinder unit 36. A number of resilient gripping fingers 24 corresponding approximately to the length of the metal tube 20 are attached to the upper free end of the pivot arm 23; these fingers retain the metal tube 20 during threading of the wire 30. Once the two wire ends have been pulled through the metal tube 20, the arm 23 is swung, with the aid of the drive mechanism 36, into the position indicated in dot-dash lines so that now, without impairing the gripping fingers 24, the metal tube 20 can be crimped into the seal 20' according to FIG. 3. In the swung-out condition, a new metal tube is then pushed into the gripping fingers 24 with the aid of the drive mechanism 25 from a magazine 26, so that the opened crimping jaws, 27, 28 according to FIG. 3 can again be provided with a metal tube 20.

The metal tube crimping means according to FIG. 3 for producing a seal 20' consists of two crimping jaws 27, 28, of which the one designated by reference numeral 27 is fixedly mounted. The crimping jaw 28, in contrast thereto, moves, for producing the seal 20', in the directions of arrow 29 toward and then away from the crimping jaw 27. However, before this working step can be performed, the wire 30 pulled from the supply coil 19 is pushed through the small metal tube 20 held by the gripping fingers 24 between the crimping jaws 27 and 28. At the outlet side of the metal tube 20, the wire 30' exits from the metal tube crimping device and subsequently loops around the bale 1 according to FIG. 1 in the manner described in connection therewith. With the aid of the guide arm 18 retained at the wrapping device 5, the free end of the wire 30'' then returns to the metal tube crimping device of FIG. 3 and is again pushed through the metal tube 20. At this time, a slide 31 mounted to the rear side of the crimping unit is shifted into the illustrated position so that the blind bore 21 provided in this slide 31 is located at the level of the outlet opening of the metal tube 20. With the aid of the wire feed means 12, the end of the wire 30'' thus abuts within the blind bore 21, whereupon the feed 12 is arrested with the aid of the limit switch. Now the slide 31 moves in the direction of arrow 32 into the position illustrated in dot-dash lines so that the end of the wire 30'' projecting from the metal tube 20 is bent in the direction of arrow 32. Thereby the wire 30'' is fixed at its end to the metal tube 20 so that now the wire feed means 12 can be driven to operate in the opposite direction in order to obtain tightening of the wire 30 about the bale 1. After the tightening process, the metal tube crimping device is in close contact with the bale 1, as shown in FIG. 3. In order to produce the seal 20', the crimping jaw 28 now moves to the right in the direction of arrow 29 into the position indicated in dot-dash lines, so that at this point the tube 20 is crimped together and a permanent connection is established between the two wire ends 20' and 30''.

However, the wire 30 is still in connection with the supply coil 19. According to this invention, the severing step is performed simultaneously with the production of the seal 20', but with a delay for the sake of safety. For this purpose, two cutting slides 33, 34 are arranged facing each other at the inlet to the crimping device, according to FIG. 3. During movement of the crimping jaw 28 in the direction of arrow 29, the cutting slides 33, 34 thus also move toward each other and sever the wire 30 from the supply coil 19. At the same time, the slide 31 moves back in the direction of arrow 35 into the position shown with solid lines so that the end of the wire 30'' is straightened again.

The invention claimed is:

1. A method of wrapping a bale of fibers with a metal wire or band which comprises withdrawing the wire from a supply coil, extending the wire around the bale, tightening the wire around the bale while the wire is still connected to the supply coil, and joining a free end of the wire to another portion of the wire with a permanent seal or connection; an initial portion of the wire coming from the supply coil first being passed with its free end through a metal tube held in readiness; the free end and adjacent end portion of the wire then being moved around the bale; the free end of the wire then being guided a second time into the metal tube, the free end completely passing through the metal tube to be fixed to the tube, and a short, projecting section of the wire being bent about an end of the metal tube; the wire then being tightened about the bale by rearward movement of the initial portion of wire through the metal tube; the metal tube being crimped to form the seal or connection; and the portion of the wire still connected to the supply coil being severed.

2. A method according to claim 1, wherein the wire is separated from the supply coil at the same time as the crimping of the metal tube to form the seal.

3. A method according to claim 2, wherein continuously a metal tube is seized from a magazine by means of a holding device, the tube is held into the path of movement of the wire, wire is passed twice through the metal tube, the free end of the wire is fixed in place, and then the holding device is separated from the metal tube for the subsequent crimping of the metal tube to form the seal.

4. A method according to claim 1, wherein continuously a metal tube is seized from a magazine by means of a holding device, the tube is held into the path of movement of the wire, wire is passed twice through the metal tube, the free end of the wire is fixed in place, and then the holding device is separated from the metal tube for the subsequent crimping of the metal tube to form the seal.

5. A method according to claim 1, wherein after crimping of the metal tube, the section of the wire that had been bent at the end of the tube is straightened again.

* * * * *